US009168442B2

(12) United States Patent
Covino et al.

(10) Patent No.: US 9,168,442 B2
(45) Date of Patent: Oct. 27, 2015

(54) GAMING SURFACE AND GAME STYLED AFTER AMERICAN FOOTBALL

(76) Inventors: Thomas M. Covino, San Antonio, TX (US); William Rohn, Manhasset, NY (US)

( * ) Notice: Subject to any disclaimer, the term of this patent is extended or adjusted under 35 U.S.C. 154(b) by 76 days.

(21) Appl. No.: 13/238,603

(22) Filed: Sep. 21, 2011

(65) Prior Publication Data

US 2012/0010010 A1 Jan. 12, 2012

Related U.S. Application Data

(63) Continuation-in-part of application No. 12/586,323, filed on Sep. 21, 2009, now abandoned.

(60) Provisional application No. 61/403,777, filed on Sep. 21, 2010.

(51) Int. Cl.

| | |
|---|---|
| ***A63B 69/36*** | (2006.01) |
| ***A63B 67/02*** | (2006.01) |
| *A63B 57/00* | (2015.01) |
| *A63F 7/06* | (2006.01) |

(52) U.S. Cl.

CPC ..... *A63B 67/02* (2013.01); *A63B 57/0056* (2013.01); *A63B 69/3661* (2013.01); *A63B 2210/50* (2013.01); *A63F 7/0628* (2013.01)

(58) Field of Classification Search

CPC .. A63B 67/02; A63B 67/002; A63B 69/3691; A63B 69/3661; A63B 69/3697; A63B 69/3676

USPC ..... 473/159–163, 470–472, 168, 169

See application file for complete search history.

(56) References Cited

U.S. PATENT DOCUMENTS

| | | | | |
|---|---|---|---|---|
| 1,851,423 | A * | 3/1932 | Ely | 473/168 |
| 2,490,961 | A * | 12/1949 | Hendry | 473/168 |
| 3,464,703 | A * | 9/1969 | Vallas | 473/158 |
| 3,580,573 | A * | 5/1971 | Noonan et al. | 473/470 |
| 3,649,027 | A * | 3/1972 | Vallas | 473/169 |

(Continued)

FOREIGN PATENT DOCUMENTS

| | | |
|---|---|---|
| WO | WO 94/08667 A1 | 4/1994 |
| WO | WO 00/47293 A1 | 8/2000 |

OTHER PUBLICATIONS

Sullivan, P.; photo: "KU Football Field/Putting Green"; Retrieved from WWW2.ljworld.com/photos/galleries/2008/02/2008_ncaa_fan_submission/43373/.

(Continued)

*Primary Examiner* — Mark Graham
(74) *Attorney, Agent, or Firm* — Baker & Hostetler LLP

(57) ABSTRACT

In one embodiment, the present invention is a surface for playing a game based on the rules of American football using a golf putter and golf ball. The playing surface comprises two end zones and a grid representing the yard lines of a football field. A first down putting target is positioned adjacent to each yard line that is a multiple of ten, and a scoring putting target is positioned in each end zone. In another embodiment, the present invention is a method for playing the game. Two teams compete against one another and are given alternating offensive possessions. In each offensive possession, the offensive team has four downs to either putt the ball in a first down target, thereby obtaining a new set of four downs, or putt the ball in the scoring target. With each first down achieved, the ball advances closer to the scoring target.

18 Claims, 3 Drawing Sheets

(56) References Cited

U.S. PATENT DOCUMENTS

| | | | | | |
|---|---|---|---|---|---|
| 3,912,270 | A | | 10/1975 | Trossman et al. | |
| 4,373,734 | A | * | 2/1983 | Frank | 473/471 |
| 4,572,512 | A | * | 2/1986 | Tegart | 473/151 |
| 4,687,208 | A | * | 8/1987 | Thomas | 473/470 |
| 4,696,474 | A | | 9/1987 | Tegart | |
| 4,726,589 | A | * | 2/1988 | Grigas | 473/169 |
| 4,743,026 | A | * | 5/1988 | Eady | 473/162 |
| 5,031,916 | A | * | 7/1991 | Boswell | 473/158 |
| 5,207,433 | A | * | 5/1993 | Moore | 473/470 |
| 5,265,875 | A | * | 11/1993 | Fitzgerald | 473/169 |
| 5,419,561 | A | * | 5/1995 | Weber | 473/409 |
| 5,549,293 | A | * | 8/1996 | Seifert | 273/317.3 |
| 6,045,466 | A | * | 4/2000 | Suess | 473/470 |
| 6,623,370 | B1 | | 9/2003 | Willer | |
| 7,101,293 | B2 | | 9/2006 | Tarng et al. | |
| 7,422,531 | B2 | | 9/2008 | Tarng et al. | |
| 8,016,290 | B1 | | 9/2011 | Rhodes | |
| 8,287,395 | B2 | * | 10/2012 | Green et al. | 473/172 |
| 2004/0209712 | A1 | | 10/2004 | Tarng et al. | |
| 2005/0119072 | A1 | * | 6/2005 | Pettey | 473/470 |
| 2005/0153788 | A1 | | 7/2005 | Saldana | |
| 2006/0105850 | A1 | * | 5/2006 | McNamara | 473/168 |
| 2007/0042829 | A1 | * | 2/2007 | Dennesen | 473/162 |
| 2009/0033034 | A1 | | 2/2009 | Jakubowski | |
| 2011/0028249 | A1 | * | 2/2011 | Ofori-Ansah | 473/471 |
| 2011/0086732 | A1 | * | 4/2011 | Press | 473/471 |
| 2011/0195806 | A1 | * | 8/2011 | Perez | 473/470 |
| 2012/0021855 | A1 | * | 1/2012 | Brown | 473/470 |

OTHER PUBLICATIONS

"Basketball Golf"; Retrieved from www.62sports/details.php-?prodId=83&category=83.

"BaseGold"; Alitius, 2003-2008; Retrieved from www.filesland.com/companies/alitius/BaseGolf.html.

* cited by examiner

GAMING SURFACE AND GAME STYLED AFTER AMERICAN FOOTBALL

CROSS-REFERENCE TO RELATED APPLICATIONS

This application claims the benefit of the filing date of U.S. provisional application no. 61/403,777, filed on Sep. 21, 2010, and U.S. patent application Ser. No. 12/586,323, filed on Sep. 21, 2009, the teachings of all of which are incorporated herein by reference in their entirety.

BACKGROUND OF THE INVENTION

1. Field of the Invention

The present invention relates to games of skill, and, more specifically but not exclusively, to games that may be played based on the rules of American football.

2. Description of the Related Art

Golf is a game of skill played on a course typically having 18 separate playing surfaces, each playing surface having its own hole. The 18 playing surfaces are played in succession, and for each playing surface, a golf ball is struck one or more times with one or more golf clubs until the ball lands in the corresponding hole. The object of golf is to land the ball into each hole using the fewest number of strikes of the golf clubs. Scoring is kept by counting the number of times a player strikes the ball. The fewer the number of strikes, the better the score.

American Rules football (herein referred to as football and not to be confused with soccer) is also a game of skill. However, the rules of football are vastly different from the rules of golf. Football is played on a single playing surface that is marked with grid lines, referred to as yard lines, wherein each yard line is spaced apart from each adjacent yard line by five yards. Two teams compete against one another, and with alternating possessions of a football, each team tries to get the football into the end zone of the opposing team. In each possession, the team with the football (i.e., the offensive team) gets four chances, referred to as downs, to either (i) score or (ii) achieve a new set of four chances (i.e., a new set of four downs). Scoring occurs when the offensive team advances the ball past a goal line and into the end zone of the opposing team or kicks a field goal. A new set of downs is achieved when the offensive team advances the ball ten yards.

SUMMARY OF THE INVENTION

In one embodiment, the present invention is a gaming surface for playing a game, the gaming surface comprising a first playing area. The first playing area comprises a first marker, a first non-scoring target, and a first scoring target. The first marker corresponds to a starting position for a player to set a game piece in motion. The first non-scoring target is adapted to receive a game piece at rest and is spaced from the first marker by a first distance. The first scoring target is adapted to receive a game piece at rest and is spaced from the first marker by a second distance, greater than the first distance. Further, the first non-scoring target is positioned in an area that is between the first marker and the first scoring target.

In another embodiment, the present invention is a method for operating a game. The method comprises providing a gaming surface, substantially similar to the gaming surface described in the previous paragraph. The method further comprises providing to a first team a set of one or more chances to advance a game piece from the first marker to one of (i) the first non-scoring target and (ii) the first scoring target. The method yet further comprises providing to the first team, if the game piece is advanced to the first non-scoring target within the set of one or more chances, a new set of one or more chances to advance the game piece to the first scoring target.

In yet another embodiment, the present invention is a method for operating a game, the method comprising using a golf club and golf ball to implement one or more rules of American football.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The present invention relates to playing surfaces that resemble American Rules football fields and methods for playing games on these playing surfaces using golf equipment such as a golf ball and putter. In general, the games are played using rules similar to those used in football, although they are tailored to putting a golf ball. Like football, in games of the present invention, a team is given a set of chances (i.e., downs) to either (i) score or (ii) obtain a new set of chances to score (i.e., obtain a new set of downs). A new set of chances to score is obtained by successfully putting the ball into an intermediate (i.e., first down) target on the playing surface, and a score is obtained by successfully putting the ball into the ultimate (i.e., scoring) target on the playing surface.

Overview of the Playing Surface

Figure 1:
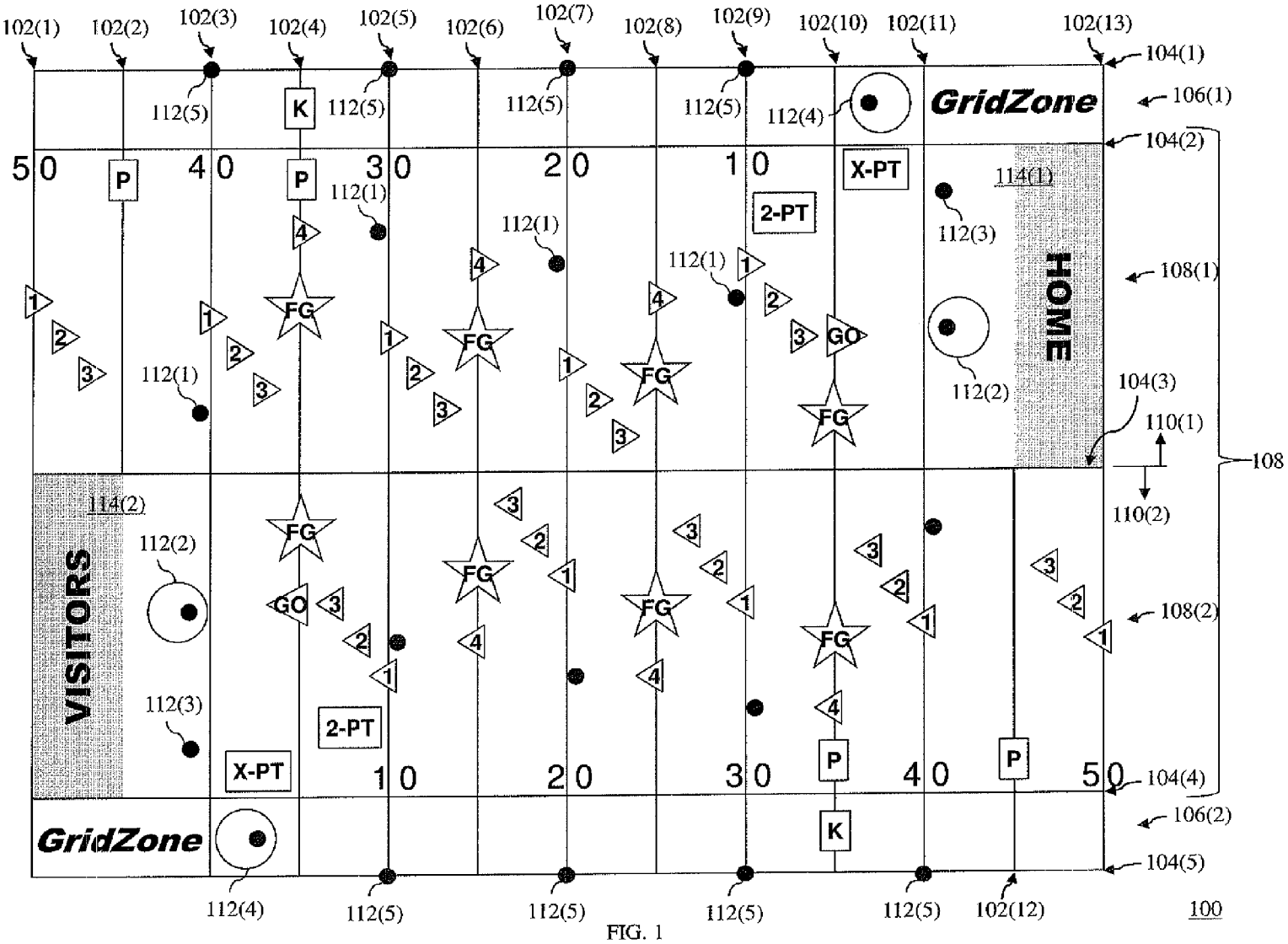
FIG. 1 shows an overhead view of a playing surface according to one embodiment of the present invention on which games of the present invention may be played.

FIG. 1 shows an overhead view of a playing surface 100 according to one embodiment of the present invention on which games of the present invention may be played. Playing surface 100, which is fashioned after an American football field, has an approximately rectangular shape that is defined by two end lines 102(1) and 102(13) and two sidelines 104(1) and 104(5). Playing surface 100 may be constructed using any surface material, or combination of materials, suitable for putting, such as grass, dirt, artificial turf, rubberized surfaces, carpet, and cloth tarp. Playing surface 100 is defined by a number of substantially horizontal lines 104(1) to 104(5) and vertical lines 102(1) to 102(13) that may be delineated using any suitable marking technique, or combination of marking techniques. For example, the lines may be painted, drawn with chalk, marked out with tape, constructed by alternating the colors of the surface materials, or may be delineated by two or more of these techniques.

Playing surface 100 is divided into upper half 110(1) and lower half 110(2) by interior horizontal line 104(3), herein referred to as the midline. In this embodiment, upper half 110(1) is referred to as the "home team" portion of playing surface 100, and lower half 110(2) is referred to as the "visitor team" portion of playing surface 100. According to other embodiments, the home team and visitor team portions may be switched. For purposes of this specification and the appended claims, a "team" may comprise, in some instances, only one player, and in other instances, more than one player. Further, the present invention is not limited to the use of the terms home team and visitor team. Aside from the designations home team and visitor team, lower half 110(2) is substantially identical to upper half 110(1), only rotated by 180 degrees.

Upper half 110(1) is divided by horizontal line 104(2) into an upper area 106(1), herein referred to as the home team's "kicking and receiving area," and a lower area 108(1), herein referred to as the home team's "field of play." Similarly, lower half 110(2) is divided by horizontal line 104(4) into a lower area 106(2), herein referred to as the visitor team's kicking and receiving area, and an upper area 108(2), herein referred to as the visitor team's field of play. Together, home team's field of play 108(1) and visitor team's field of play 108(2) form the entire field of play 108. As their names suggest, the kicking and receiving areas and the field of play have somewhat different purposes. Namely, the kicking and receiving steps of the game (described in further detail below in relation to FIG. 2) are played in kicking and receiving areas 106(1) and 106(2), and practically all of the remainder of the game (described in further detail below in relation to FIG. 3) is played in field of play 108. Note that, although areas 106(1) and 106(2) are each referred to as a "kicking and receiving area" and a "kickoff area", the present invention is not limited advancing the ball in these areas through actual kicking motions.

Playing surface 100 has eleven substantially evenly spaced interior vertical lines 102(2) to 102(12), which are substantially parallel to end lines 102(1) and 102(13). Interior vertical lines 102(2) to 102(12) correspond to the yard lines on a football field and provide indicators of how far one team has to go to reach an end zone or to make a first down. In home team's portion 110(1), end line 102(1) corresponds to the 50-yard line, and vertical lines 102(2) through 102(10) correspond to the home team's 5- through 45-yard lines, respectively. Further, vertical line 102(11) corresponds to a goal line on a football field and delineates the home team's end zone 114(1), which is situated between goal line 102(11) and end line 102(13). Note that, to allow room for the home team's end zone 114(1), vertical line 102(12) does not extend past midline 104(3) into end zone 114(1).

In visitor team's portion 110(2), end line 102(13) corresponds to the 50-yard line, and vertical lines 102(4) through 102(12) correspond to the visitor team's 5- through 45-yard lines, respectively. Further, vertical line 102(3) corresponds to a goal line on a football field and delineates the visitor team's end zone 114(2), which is situated between goal line 102(3) and end line 102(1). To allow room for home team's end zone 114(2), vertical line 102(2) does not extend past midline 104(3) into end zone 114(2). Note that, if home team's field of play 108(1) and visitor team's field of play 108(2) were aligned end to end, such that their respective 50-yard lines were adjoined, then playing surface 100 would resemble a 120-yard long football field (including 10 yards for each end zone).

According to preferred embodiments of the present invention, each vertical line 102 is spaced apart from each adjacent vertical line 102 by a fixed interval, where each foot of the fixed interval corresponds to one yard on an actual football field. In other words, according to preferred embodiments, adjacent vertical lines 102 are spaced apart by fixed intervals of ten feet, rather than ten yards. However, according to alternative embodiments of the present invention, adjacent vertical lines 102 may be spaced apart by fixed intervals of ten yards or another suitable distance. For example, the fixed intervals may be 15 feet in length, or may be measured in metric units or some other type of measure. In addition, according to alternative embodiments of the present invention, adjacent vertical lines 102 may be spaced apart by non-fixed intervals. For example, the intervals between vertical lines 102 could become larger closer to an end zone 114, making it more difficult for a team or player to score as the team or player gets closer to the end zone 114. Although vertical lines 102(1) to 102(13) may be spaced apart using any suitable measure, vertical lines 102(1) to 102(13) correspond to the yard lines on a football field. Thus, for ease of discussion, vertical lines 102 are referred to herein as yard lines in deference to football.

In preferred embodiments of the present invention (i.e., those where each foot represents one yard on an actual football field), playing surface 100 is 60 feet long and 40 feet wide. However, according to various embodiments of the present invention, these dimensions can vary based on factors such as the width of the intervals between vertical lines 102 and the area made available on which playing surface 100 is to be installed.

Playing surface 100 has eight intermediate targets 112(1) in field of play 108, which are herein referred to as first down targets. In home team's field of play 108(1), a first down target 112(1) is located adjacent to each of vertical line 102(9) (i.e., the home team's 10-yard line), vertical line 102(7) (i.e., the home team's 20-yard line), vertical line 102(5) (i.e., the home team's 30-yard line), and vertical line 102(3) (i.e., the home team's 40-yard line). Similarly, in visitor team's field of play 108(2), a first down target 112(1) is located adjacent to each of vertical line 102(5) (i.e., the visitor team's 10-yard line), vertical line 102(7) (i.e., the visitor team's 20-yard line), vertical line 102(9) (i.e., the visitor team's 30-yard line), and vertical line 102(11) (i.e., the visitor team's 40-yard line). The positions of first down targets 112(1) relative to midline 104(3) may be arbitrary as shown (i.e., some may be closer to midline 112 and others may be farther from midline 112, in no particular pattern). Alternatively, first down targets 112(1) may be the positioned according to a desired pattern or patterns (e.g., first down targets 112(1) may be positioned increasingly closer to the midline as the yardage decreases).

First down targets 112(1) may be constructed using, for example, holes such as the regulation holes used on golf courses, other receptacles capable receiving golf balls, including those that do not penetrate playing surface 100, colored or outlined zones delineated using a suitable marking technique such as those described above, or a combination of two or more of these, such as a hole within a colored zone. Further, first down targets 112(1) are may be circular in shape, or may be other suitable shapes such as ovals, squares, triangles, rectangles, or irregular shapes. As described below, when a person or team lands a putt into one of these first down targets 112(1), the person or team is awarded a new set of chances, commonly referred to as new set of downs in football.

In addition to first down targets 112(1), field of play 108 has two scoring targets 112(2) and two bonus targets 112(3), where one scoring target 112(2) and one bonus target 112(3) is located in each of home team's end zone 114(1) and visitor team's end zone 114(2). Scoring targets 112(2) and bonus targets 112(3) may be constructed in any of the manners described above in relation to first down targets 112(1). Preferably, bonus targets 112(3) are constructed using standard regulation holes used on golf courses. Further, according to preferred embodiments of the present invention, scoring targets 112(2) are constructed in accordance with one or both of (i) scoring targets disclosed in U.S. patent application Ser. No. 12/586,323, and (ii) the commercial product sold under the brand BirdZone®. According to some embodiments, BirdZone®-brand putting targets and scoring targets disclosed in U.S. patent application Ser. No. 12/586,323 comprise an outlined or colored zone, wherein a hole such as a standard regulation hole used on a golf course divides (i) the zone into two sub-regions whose areas form approximately a 2:3 ratio, or (ii) a diameter of the zone into two line segments, whose lengths form approximately a 2:3 ratio.

Kicking and receiving areas 106(1) and 106(2) also contain a number of targets. In particular, each kicking and receiving area 106 contains (1) a kickoff target 112(4) between its goal line and fifth yard line, and (2) four kick return targets 112(5), one at each of the 10-, 20-, 30-, and 40-yard lines. Kickoff targets 112(4) and kick return targets 112(5), which are used as described below, may be constructed using any of the target constructions described above. However, kickoff targets 112(4) are preferably constructed using the BirdZone® putting targets, and kick return targets 112(5) are preferably constructed using standard regulation holes used on golf courses.

In addition to targets 112, playing surface 100 also contains a number of spotting markers (not labeled), which are markings on playing surface 100 that indicate where the ball is spotted during different stages of the game. As used herein, the terms "spotting", "spot", and "spotted" refer to the placing of the ball on the field for the next play, just as these terms are used in football. Each spotting marker is designated by a shape having either a number or letter(s) within its borders. Playing surface 100 has seven different types of spotting markers: (1) down markers, (2) go-for-it markers, (3) punt markers, (4) field goal markers, (5) two-point conversion markers, (6) extra-point markers, and (7) kickoff markers.

There are four different down markers, first down, second down, third down, and fourth down, which are represented as triangles containing the numbers 1, 2, 3, and 4, respectively. The down markers indicate the location from where putts are taken on each down. First down markers are positioned on the 50-, 40-, 30-, 20-, and 10-yard lines 102 of each of home team's field of play 108(1) and visitor team's field of play 108(2). For each first down marker, a second down marker is positioned between the first down marker and the adjacent vertical line 102 towards the end zone 114, and a third down marker is positioned between the second down marker and the adjacent vertical line 102 towards the end zone 114. For example, in home team's field of play 108(1), a first down marker is positioned on the home team's 40-yard line 102(3), a second down marker is positioned between the first down marker and home team's 35-yard line 102(4), and a third down marker is positioned between the second down marker and home team's 35-yard line 102(4).

For each first down marker, there may also be a fourth down marker that is positioned on the adjacent vertical line 102 towards the end zone 114. Continuing the previous example, a fourth down marker is positioned on the 35-yard line 102(4) of the home team's field of play 108(1). Note that there are no fourth down markers on the 45-yard lines of home team's field of play 108(1) and visitor team's field of play 108(2). According to alternative embodiments of the present invention, there may be fourth down markers on the 45-yard lines. Further, note that there are no fourth down markers on the 5-yard lines of home team's field of play 108(1) and visitor team's field of play 108(2). Rather, each 5-yard line has a go-for-it marker represented by a triangle with the word "Go" inside. The go-for-it markers are used when the ball is inside the offensive team's 10-yard line and a team wishes to go for a touchdown on fourth down.

The punt markers, represented as boxes with the letter "P" inside, indicate the location from where putts are taken when a team chooses to punt to the other team. According to the embodiment of FIG. 1, punt markers are positioned only on the 45- and 35-yard lines of each of the home team's field of play 108(1) and visitor team's field of play 108(2). According to alternative embodiments, a greater or lesser number of punt markers may be positioned on each team's field of play 108, and the locations of the punt markers may vary from those shown in FIG. 1.

The field goal markers, represented as stars with the letters "FG" inside, indicate the location from where putts are taken when a team chooses to kick a field goal. According to the embodiment of FIG. 1, field goal markers are positioned on the 35-, 25-, 15-, and 5-yard lines of each of the home team's field of play 108(1) and visitor team's field of play 108(2). According to alternative embodiments, a greater or lesser number of field goal markers may be positioned on each team's field of play, and the locations of the field goal markers may vary from those shown in FIG. 1.

Two-point conversion markers, represented as boxes with the abbreviation "2-PT" inside, indicate the location from where putts are taken when a team chooses to go for an extra point after a touchdown. In each of home team's field of play 108(1) and visitor team's field of play 108(2), a two-point conversion marker is positioned between the 5- and 10-yard lines. Extra point conversion markers, represented as boxes with the abbreviation "X-PT" inside, indicate the location from where putts are taken when a team chooses to go for an extra point after a touchdown. In each of home team's field of play 108(1) and visitor team's field of play 108(2), an extra-point conversion marker is positioned between the 5- and 10-yard lines.

Kickoff markers, represented as boxes with the letter "K" inside, indicate the location from where putts are taken when a team kicks off to the other team. Playing surface 100 has two kickoff markers, one located on the 35-yard line in each of home team's kicking and receiving area 106(1) and visitor team's kicking and receiving area 106(2). According to alternative embodiments of the present invention, the kickoff markers may be located on yard lines other than the 35-yard lines.

According to various embodiments, playing surfaces of the present invention may vary from playing surface 100. For example, various playing surfaces of the present invention may be implemented with only one kicking and receiving zone that is shared by both teams. The single kicking and receiving zone may be located at the top or bottom of the playing surface or may be located between the home team's half and the visitor team's half. Further, the single kicking and receiving zone could have two kickoff targets located on opposite ends of the kicking and receiving zone.

As another example, various playing surfaces of the present invention may be implemented with only one field of play that is shared by both teams. As yet another example, the home team's half and the visitor team's half can be aligned end-to-end such that their respective 50-yard lines are adjoined, resulting in a 120 foot long field. As even yet another example, the first down targets could be located at intervals other than at 10-yard intervals. As even yet still another example, the locations of some or all of the spotting markers such as the down markers, the kickoff markers, the punting markers, and the field goal markers may vary from the locations shown in FIG. 1, or some or all of these markers could be omitted entirely.

Kicking and Receiving

According to various embodiments of the present invention, play begins when one team invokes a coin toss to select either (1) whether to kick or to receive or (2) whether to be assigned to the home team's half 110(1) or the visitor team's half 110(2). Commonly, but without limitation, the team winning the coin toss makes either the kick vs. receive determination or the home vs. visitor determination, and the team losing the coin toss makes whichever determination was not made by the coin-toss winning team. Other assignment mechanisms can be used to make these determinations (e.g., taking turns, results of prior contests, etc.), and the presently disclosed invention is not limited to a coin toss. Upon making the kick vs. receive and home vs. visitor determinations, a kickoff is conducted as discussed in relation to FIG. 2.

Figure 2:
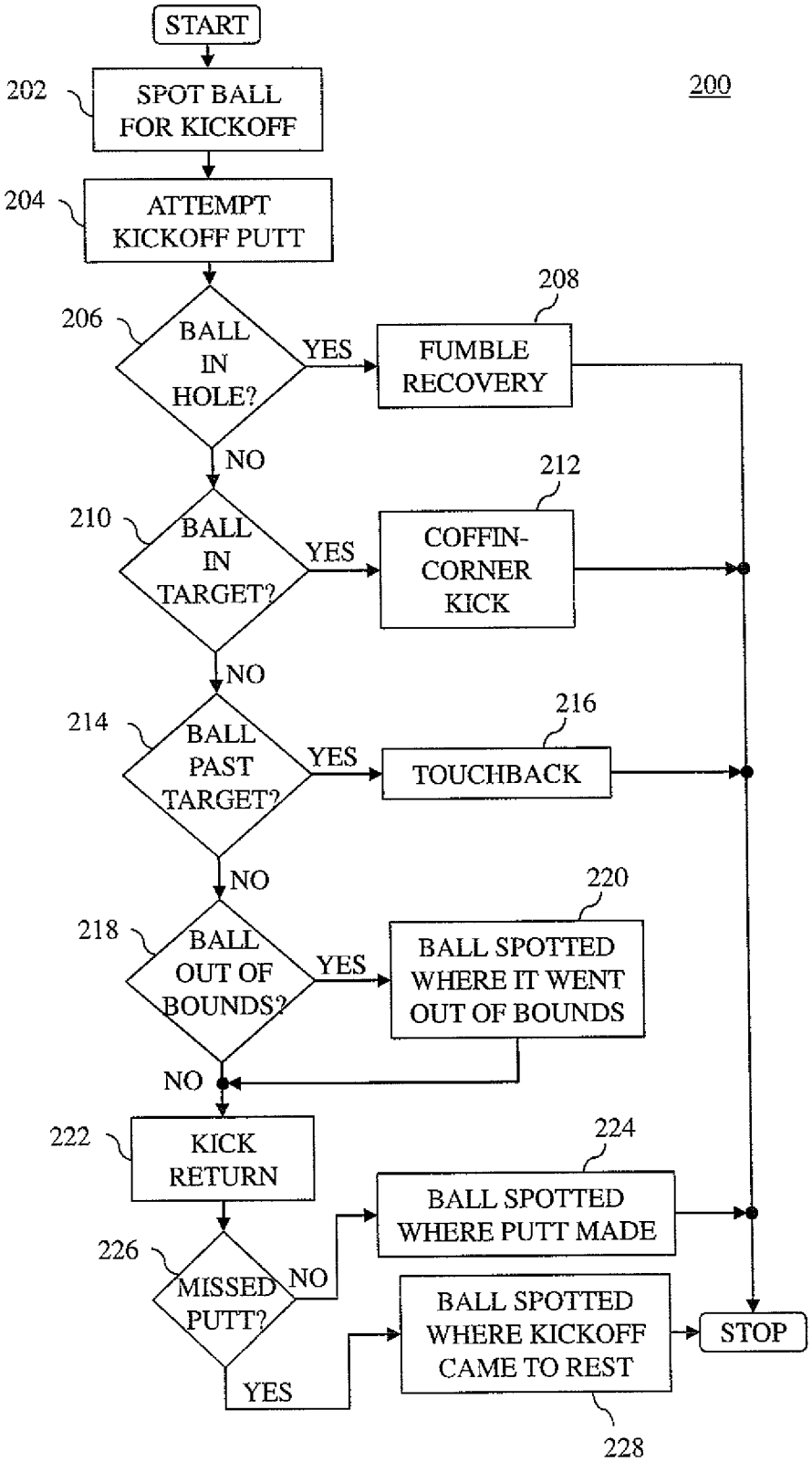
FIG. 2 shows a simplified flow diagram of one method for conducting a kickoff according to one embodiment of the present invention.

FIG. 2 shows a simplified flow diagram of one method 200 for conducting a kickoff according to one embodiment of the present invention. Method 200, which may be performed on playing surface 100 or playing surfaces of alternative embodiments of the present invention, is performed once for each kickoff. The kickoff begins with the kicking team spotting the ball on the kickoff marker of the kicking team's kicking and receiving area 106 (step 202). The kicking team then attempts to putt the ball towards the kickoff target 112(4) (step 204). This action is herein referred to as the kicking putt or kickoff. For this discussion, suppose that kickoff targets 112(4) are constructed to have a standard regulation golf hole positioned in an outlined or colored zone (e.g., similar to the BirdZone® targets).

When the kicking team putts the ball, the ball can come to rest at any one of five different locations. In particular, the ball can land (1) in the hole of kickoff target 112(4), (2) in the outlined or colored zone of kickoff target 112(4) (but not in the hole), (3) past kickoff target 112(4), (4) in front of kickoff target 112(4) and outside the upper and lower bounds of kicking and receiving area 106 (i.e., not between horizontal lines 104(1) and 104(2) or 104(4) and 104(5)), or (5) in front of kickoff target 112(4) and inside the upper and lower bounds of kicking and receiving area 106. As described below, a different outcome results for each different location where the ball can come to rest.

If the ball comes to rest in the hole of kickoff target 112(4) (step 206), then the kicking team is considered to have recovered a fumble deep in the receiving team's territory (step 208). In such a situation, the kicking team is given possession at a highly advantageous field position, which may be, for example, the 10-yard line of the kicking team's field of play 108. If the ball comes to rest in the outlined or colored zone of kickoff target 112(4) (step 210), but not in the hole, then the kicking putt is treated as a "coffin-corner kick" (step 212). In such a situation, the receiving team starts its offensive possession at a highly disadvantageous field position, which may be, for example, the 50-yard line of the receiving team's field of play 108. If the ball comes to rest past kickoff target 112(4) (step 214), then the kicking putt is treated as a touchback (step 216). In such a situation, the receiving team starts its offensive possession at a designated yard line within its own territory, which may be, for example, the 30-yard line of the receiving team's field of play 108.

Often, the kicking putt will not reach kickoff target 112(4). If the ball comes to rest in front of kickoff target 112(4), and outside the upper and lower bounds of kicking and receiving area 106 (step 218), then the point where the ball went out of bounds is treated as the location where the ball came to rest (step 220). In such a situation, the receiving team is given an opportunity to return the kicking putt in the direction of the kicking marker by making its own return putt (step 222) from the location where the ball went out of bounds as discussed below. Similarly, if the kicking putt comes to rest in front of kickoff target 112(4), and inside the upper and lower bounds of kicking and receiving area 106, then the receiving team is given an opportunity to return the kicking putt in the direction of the kicking marker by making its own return putt (step 222) from the location where the ball came to rest. According to alternative embodiments of the present invention, the return putt may be taken from a pre-determined yard line, such as the kicking team's 10-yard line (i.e., the return team's 30-yard line) when the kicking putt goes out of bounds and/or when it stays in bounds.

In making a return putt, the receiving team directs its putt to one of the four kick return targets 112(5) towards the direction from where the kickoff was made. If the receiving team makes a successful putt (step 226), then the receiving team takes possession of the ball on the yard line 102 corresponding to the kick return target 112(5) where the putt was made (step 224). This procedure allows a more experienced receiving team to go for a more ambitious field position by attempting a longer return putt at one of the farther kick return targets 112(5) while simultaneously permitting a less experienced receiving team to play safer odds. If the return putt misses one of the intended kick return targets 112(5) (step 226), then the ball is considered to have been returned only to the 10-divisible yard line 102 behind the landing position of the kicking putt (step 228) (e.g., the 20-yard line, if a returning putt is missed from the 23-yard line).

Once the kicking and receiving procedures are finished, field position is determined by where the ball ends up. Offensive play (discussed below) then begins from within the field of play 108 based upon the final ball position from the kicking and receiving procedures. This is accomplished by physically moving the ball from the kicking team's kicking and receiving area 106 along the vertical line 102 that the ball was spotted to the receiving team's field of play 108 (that is, unless there is a fumble recovery, in which case, the ball is moved to the 10-yard line of the kicking team's field of play 108). Thus, if the kickoff and return putts leave the ball on the 10-yard line of the kicking team's kicking and receiving area 106, then the ball is then transported up (or down) that vertical line 102 into the receiving team's field of play 108 without any vertical movement whatsoever. In this situation, the receiving team then takes possession from its own 30-yard line, which is on the same vertical line 102 as the kicking team's 10-yard line.

As an example of method 200, suppose that the home team is the kicking team. The home team spots the ball on the kickoff marker located on vertical line 102(4) (i.e., the 35-yard line) in home team's kicking and receiving area 106(1) and attempts to putt the ball towards kickoff target 112(4) located between vertical lines 102(10) and 102(11) (i.e., between the goal line and the 5-yard line). If the kicking putt comes to rest in the hole of kickoff target 112(4), resulting in a fumble, then the home team takes possession of the ball at the 10-yard line of the home team's field of play 108(1) (i.e., vertical line 102(9)). If the kicking putt comes to rest in the outlined or colored zone of kickoff target 112(4), but not in the hole, then the visitor team takes possession of the ball at the 50-yard line of the visitor team's field of play 108(2) (i.e., vertical line 102(13)). If the kicking putt comes to rest past kickoff target 112(4), resulting in a touchback, then the visitor team takes possession of the ball at the 30-yard line of the visitor team's field of play 108(2).

If the kicking putt crosses over side line 104(1) at the 13-yard line and comes to rest outside home team's kicking and receiving area 106(1), or if the kicking putt comes to rest on the 13-yard line within home team's kicking and receiving area 106(1), then the visitor team is given an opportunity to make a return putt to any one of the kick return targets 112(5) on the 20-, 30-, and 40-yard lines of the home team's kicking and receiving area 106(1). Suppose that the visitor team makes the putt at the kick return target 112(5) on the 30-yard line of home team's kicking and receiving area 106(1). In this situation, the visitor team takes possession of the ball on the 10-yard line of the visitor team's field of play 108(2) (i.e., the ball is transferred down from the 30-yard line of the home team's kicking and receiving area 106(1)). Now suppose that the visitor team misses the return putt at one of the kick return targets 112(5) in the home team's kicking and receiving area 106(1). In this situation, the visitor team takes possession of the ball on the 30-yard line of the visitor team's field of play 108(2) (i.e., the ball is transferred down from the 10-yard line of the home team's kicking and receiving area 106(1)).

Although the embodiment of FIG. 2 was described relative to specific outcomes that occur based on the location where the kickoff putt comes to rest, the present invention is not so limited. These outcomes may vary from one embodiment of the present invention to the next. For example, according to some embodiments, if the kickoff putt comes to rest in the hole, then the kickoff team is awarded a touchdown, and the rules for making an extra point or two-point conversion (as discussed below in relation to FIG. 3) are followed.

Conceivably the treatment for kickoff putts coming to rest in the hole, kickoff putts coming to rest in the kick return target 112(5), and kickoff putts coming to rest past the kick return target 112(5) can be treated quite differently than described above in relation to FIG. 2. For example, any of the foregoing outcomes could be changed or switched with one another. Preferably, however, kickoff putts coming to rest in the hole of kick return target 112(5) are treated as highly successful events for the kicking team, which is, in turn, given highly preferential treatment (e.g., a touchdown, deep-territory fumble recovery, etc.). Kickoff putts coming to rest in the colored or outlined zone of the kick return target 112(5) are also preferably treated with great deference towards the kicking team, although they are preferably treated with less deference than kickoff putts coming to rest in the hole. Kickoff putts coming to rest past the kick return target 112(5) are preferably treated without much deference to the kicking team.

According to various embodiments of the present invention, a kickoff putt that goes out of bounds and comes to rest in front of kickoff target 112(4) may be spotted based on the location where the putt went out of bounds without giving the return team an opportunity to return the kickoff.

According to further embodiments of the present invention, the kicking and receiving rules may vary based on variations in the playing surface. For example, suppose that home team's field of play 108(1) and visitor team's field of play 108(2) of playing surface 100 were aligned end to end, such that their respective $50^{th}$ yard lines were adjoined and the resulting playing surface resembled a 120-yard long football field (including 10 yards for each end zone). In such a case, the rules for translating turnovers, kickoffs, etc. may be changed to accommodate this alternative playing surface.

Playing Offense

Figure 3:
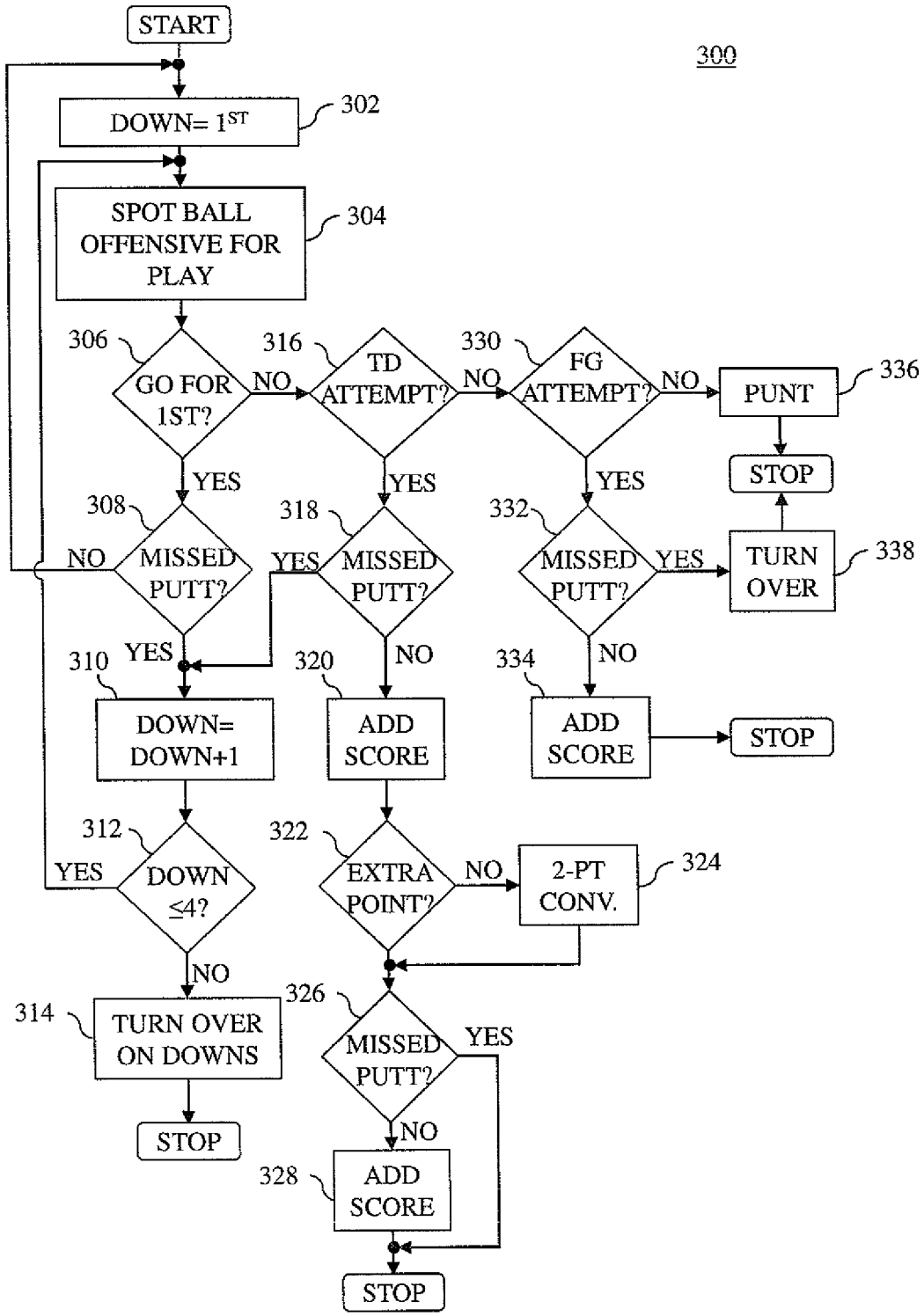
FIG. 3 shows a simplified flow diagram of one method for playing offense according to one embodiment of the present invention.

FIG. 3 shows a simplified flow diagram of one method 300 for playing offense according to one embodiment of the present invention. Method 300, which may be performed on playing surface 100 or playing surfaces of alternative embodiments of the present invention, is performed once each time a team has possession of the ball. At the beginning of the game, a team may obtain possession of the ball by following kicking and receiving method 200 described above or by some other suitable method, such as by holding a coin toss to determine who will get the first offensive possession. If the game is played using timed halves similar to American football (or even untimed halves), then similar methods may be used to choose the team that will get the first offensive possession of the second half. Preferably, the team that gets the first offensive possession of the second half is not the same team that gets the first offensive possession at the start of the game (of course this excludes situations where one team recovers a fumble on the kickoff as described in relation to kicking and receiving method 200). Aside from the first offensive possessions of the first and second halves, offensive possessions may be obtained when the opposing team turns the ball over on downs, scores touchdowns, and makes or misses field goals.

At the beginning of an offensive possession, the offensive team starts with the first down in a new set of downs (step 302). As used herein, a set of downs refers to a set of one or more chances that the offensive team may take to either (i) score or (ii) obtain a new set of one or more chances (i.e., obtain a first down in a new set of downs). Preferably, although without limitation, each set of downs comprises four chances (i.e., four downs).

To begin an offensive possession, the ball is spotted for offensive play (step 304). When a kickoff occurs, the particular first down marker on which the ball is spotted may be determined using a kicking and receiving method such as method 200. If a kicking and receiving method is not used, then the ball can be spotted on a specified yard line (e.g., the 30-yard line) at the beginning of each half, and after the opposing team scores. After a punt or a turnover, the particular first down marker on which the ball is spotted may be determined based on the location of the turnover as discussed below. In any event, for any first down, the ball is preferably spotted on the first down marker of one of the 10-, 20-, 30-, 40-, or 50-yard lines. However, if so desired, the ball may be spotted on an un-marked yard line.

On each down, the offensive team may choose one of up to four options for proceeding. In particular, the offensive team may go for a first down (step 306), attempt a touchdown (step 316), attempt a field goal (step 330), or punt (step 336). If the offensive team chooses to go for a first down (step 306), then the team putts the ball towards the first down target 112(1) that is closest to the spot of the ball and that is in the direction of offensive team's scoring target 112(2). For example, if the ball was spotted on the first down marker on the home team's 50-yard line (i.e., vertical line 102(1)), then the home team putts the ball towards first down target 112(1) adjacent to the home team's 40-yard line (i.e., vertical line 102(3)).

If the first down putt comes to rest in the first down target 112(1) (step 308), then the offensive team is awarded a new set of downs (step 302), the ball is spotted on the first down marker that is adjacent to the first down target 112(1) where the putt was made (step 304), and the offensive team may again choose one of the up to four options for proceeding. For example, if the ball comes to rest in the first down target 112(1) adjacent to the home team's 40-yard line, then the ball is spotted on the first down marker on the home team's 40-yard line. If, on the other hand, the first down putt does not come to rest in the first down target 112(1) (step 308), then the offensive team may or may not get a next down depending on the number of downs the offensive team has already played. If the next down will not exceed the maximum number of downs (e.g., 4) (step 312), then the ball is spotted on the down marker for the next down (step 304). For example, if, on first down, the home team putts from the first down marker on the home team's 50-yard line and misses the first down target 112(1) adjacent to the home team's 40-yard line, then the ball is spotted on the second down marker closest to the home team's 50-yard line.

If the next down will exceed the maximum number of downs (e.g., 4) (step 312), then the ball is turned over on downs (step 314). In this case, the ball is translated up or down depending on which team has possession of the ball, to the opposing team's field of play 108, and the opposing team takes possession of the ball. In translating the ball, the ball can be spotted in the opposing team's field of play 108 in any suitable manner. For instance, the ball can be moved up or down along the vertical line 102 adjacent to the first down target 112(1) at which the offensive team was aiming (e.g., a missed putt at the home team's 30-yard line is translated to the first down marker on the visitor team's 10-yard line). As an alternative, the ball can be moved up or down along the vertical line 102 from which the fourth down putt was taken. As yet another alternative, the ball can be moved directly along the vertical line 102 but is then offset by a specified number of yards forward or backward. As even yet another alternative, the ball can be set into the opposing team's field of play 108 on a specific, fixed yard line (e.g., the opposing team's 30-yard line). Furthermore, if a specific, fixed yard line is selected, the same yard line need not be used for both teams, so that handicapping may be effected for more or less experienced teams or players. Preferably, the manner in which the ball is to be translated (after a failed fourth-down attempt) is selected before the game commences.

Instead of going for a first down, the offensive team can attempt a touchdown (step 316). In such a situation, the offensive team putts the ball from the down marker where the ball was spotted in step 304 towards the offensive team's scoring zone 112(2). According to some embodiments of the present invention, a touchdown is scored when the ball comes to rest in the hole of the offensive team's scoring zone 112(2). According to other embodiments, a touchdown is scored when the ball comes to rest in the colored or outlined zone, but not the hole, of the offensive team's scoring zone 112(2).

If a touchdown putt is missed (step 318) (i.e., does not come to rest in the hole or the colored or outlined zone as the case may be), then the offensive team may get another down (step 310) unless the offensive team has used its maximum number of downs (step 312) and consequently turned the ball over on downs (step 314). According to alternative embodiments of the present invention, the ball may be turned over to the opposing team, regardless of the number of downs already played by the offensive team, when a touchdown putt is missed. When the ball is turned over to the opposing team, the ball is translated up or down to the opposing team's field of play 108. According to some embodiments of the present invention, the ball may be spotted on a preferably predetermined yard line (e.g., the opposing team's 40-yard line) in the opposing team's field of play 108. According to other embodiments, the ball can be moved up or down along the vertical line 102 from which the touchdown putt attempt was taken.

If a touchdown putt is successfully made (step 318), then six points are added to the offensive team's score (step 320). In addition to the touchdown points, the offensive team is given an opportunity to putt for an extra point (step 322) or a two-point conversion (step 324). An extra point is attempted by spotting the ball on the offensive team's extra-point marker, and putting the ball towards the nearest bonus target 112(3). Similarly, a two-point conversion is attempted by spotting the ball on the offensive team's two-point marker, and putting the ball towards the nearest bonus target 112(3).

If the offensive team successfully makes the extra point attempt, then a point is added to the offensive team's score (step 328). If the offensive team successfully makes the two-point conversion, then two points are added to the offensive team's score (step 328). If the offensive team misses either the extra point attempt or the two-point conversion (step 326), then no points are added to the offensive team's score. In such a situation, the offensive team may kickoff to the opposing team in a manner similar to that described above in relation to kicking and receiving method 200. Alternatively, if a kickoff is not used, then the opposing team can take possession of the ball at a designated yard line as described above in relation to step 304.

If the offensive team chooses to attempt a field goal (action 330) instead of going for a first down or a touchdown, then the ball is placed on the field goal marker closest to the location where the downs are being played. The offensive team then attempts the field goal by putting the ball towards the scoring target 112(2) in the offensive team's end zone 114. For example, suppose that the ball is spotted the first, second, third, or fourth down marker located between the home team's 40- and 30-yard lines. In this situation, the home team can spot the ball on the field goal marker on the home team's 35-yard line, and attempt a field goal by putting the ball towards scoring target 112(2) in end zone 114(1). By using one of the field goal markers, the offensive team effectively declares that it is going for a field goal. According to alternative embodiments of the present invention, field goals may be attempted without field goal markers and without such declaration.

If the field goal putt comes to a rest in the colored or outlined zone of the scoring target 112(2) (step 332), then a field goal is scored, and three points are added to the offensive team's score (step 334). According to alternative embodiments of the present invention, a field goal is scored when the field-goal putt comes to a rest in the hole of scoring target 112(2). According to other embodiments, a "roughing the kicker" penalty is assessed against the opposing team when the field-goal putt comes to a rest in the hole of scoring target 112(2). In this situation, the offensive team can either (1) accept the penalty, in which case the offensive team is awarded a first down at an advantageous field position (e.g., at the offensive team's 5- or 10-yard line), or (2) decline the penalty and accept the three points normally awarded for a successful field goal.

If a field goal attempt is successful, then the offensive team may kickoff to the opposing team in a manner similar to that described above in relation to kicking and receiving method 200. Alternatively, if a kickoff is not used, then the opposing team can take possession of the ball at a designated yard line as described above in relation to step 304.

If the field goal attempt is not successful, however, the opposing team takes over possession (step 338), the ball is moved to the opposing team's field of play 108, and the opposing team is given a new set of downs. To start the new set of downs, the ball is preferably moved to the opposing team's field of play 108 on a specified yard line 102 (e.g., the opposing team's 30-yard line) after an unsuccessful field goal attempt. Alternatively, in some embodiments of the present invention, the ball may be moved along the vertical line 102 from which the field-goal was attempted. For example, if the home team missed a field goal attempt from the home team's 35-yard line, then the ball is moved down to the visitor team's 5-yard line. In some of these embodiments, adjustments in ball placement under these circumstances are permitted. For example, the ball could be moved by a fixed-distance offset.

If the offensive team chooses to kick a punt (step 336), instead of going for a first down, a touchdown, or a field goal, then the ball is placed on the punt marker closest to the location where the downs are being played. For example, rather than spotting the ball on the fourth down marker of the home team's 35-yard line, the home team can choose to punt the ball from the punt marker on the home team's 35-yard line. Punting putts are made from the punting location towards the offensive team's end zone 114, and the opposing team takes possession of the ball at the location the ball comes to a rest or goes out of bounds. If the ball goes into the end zone 114, then a touchback results. In this situation, the ball is spotted on a predetermined, fixed yard line (e.g., the opposing team's 20-yard line), and the opposing team takes possession from the first down marker at that location. According to some embodiments of the present invention, the non-punting team may be given an opportunity to conduct a solitary "punt-return putt" before a new starting field position is determined.

Miscellaneous Playing Rules

According to various embodiments, the present invention may be implemented using rules other than, or in addition to, those described above. For example, the present invention may implement safeties, which, in American Football, occur when the offensive team is tackled or forced out of bounds from within its own end zone. Analogously, various embodiments of the present invention may be envisioned in which a safety may occur when the offensive team is putting from between the 40- and 50-yard lines. In some such embodiments, a safety target (not shown) is placed in the vicinity of the first down target 112(1) adjacent to the 40-yard line. The safety target may be constructed using any of the target constructions described above, and preferably, the safety target is smaller than the first down target 112(1). If any putt attempt at the first down target 112(1) on the 40-yard line comes to rest in the safety target, then a safety is declared. In such a situation, the offensive team is penalized, by, for example, awarding the opposing team two points. In some embodiments the offensive team may also be forced to give up possession of the ball by preferably punting (e.g., from the offensive team's 45-yard) or by making a kickoff putt.

As another example, the present invention may implement interceptions, which, in American Football, occur when an offensive team passes a ball that is caught by the opposing team. In some such embodiments, an interception target (not shown), similar to the safety target described above, is placed in the vicinity of each of the first down targets 112(1) and possibly in the vicinity of scoring targets 112(2). If any first down putt attempt at a first down target 112(1) (or a scoring target 112(2)) comes to rest in the interception target, then an interception is declared. In this case, the ball is turned over to the opposing team and the ball is translated to the opposing team's field of play 108. Alternatively, these interceptions may be considered to be fumble recoveries, and may be treated in the same manner. In some embodiments of the present invention, an interception and/or fumble recovery may be implemented by allowing the opposing team to make a return putt in a manner similar to that described above in relation to kickoff returns in FIG. 2.

According to some embodiments of the present invention, the teams may choose to have a fixed number of offensive possessions. The game may then end when each team has used all of its fixed number of possessions. Further, in some of these embodiments, a team may forfeit one of their offensive possessions each time it commits a fumble or an interception.

According to other embodiments of the present invention, the game may be timed. In some embodiments, a clock may be set for the fixed duration, and play may stop when time runs out. In other embodiments, the game time may be divided into quarters and/or halves. For example, the game time can be divided into four twelve-minute quarters with a break between the second and third quarter (so-called "high school time rules"). As another example, the game time can be divided into two twenty-minute halves (so-called "college time rules"), or even four fifteen-minute quarters (so-called "pro time rules"). In some embodiments the teams change sides of the field after the halfway point of play.

According to further embodiments of the present invention, special rules may be designed to address situations where the score is tied at the end of regulation play. For example, overtime periods may be created, which are preferably, shorter duration than the regular game time. As another example, the first team to score in an overtime period may be declared the winner, thereby ending the game (so-called "sudden death overtime"). As yet another example, the entire overtime period may be played for its fixed duration. If the overtime period ends with the score still tied, in some embodiments, additional overtime periods may be played, but in other embodiments only a fixed number of overtime periods may be played until the game as a whole is considered a tie.

According to yet further embodiments of the present invention, downs, sets of downs, and/or offensive possessions may be timed. For example, downs, sets of downs, and/or offensive possessions may be limited to fixed lengths of time (e.g., two and one-half minutes for an offensive possession). In such embodiments, a separate clock (not the game clock) may be set to the fixed length of time each time a new down, set of downs, or possession occurs as the case may be. This play clock, which is fashioned after the 40 second play clock in football, begins to count down when the down, set of downs, and/or offensive possession is started (e.g., with the putt for the down, the first put of the set of downs, and/or the first putt of the offensive possession). If the possession clock runs out (counts down to zero), then the offensive team is penalized by, for example, giving up possession of the ball to the opposing team wherever the ball happens to be when the clock runs out. The possession clock is designed to prevent the team with a higher score from delaying the game, thereby preventing the opposing team from getting opportunities to score. Lining up and taking a golf putt, after all, can be done in all manner of speed or slowness, depending upon the given putter's inclinations and time resources.

Although the present invention was described relative to specific scores for a touchdown, field goal, two-point conversion, and extra point, the present invention is not so limited. In various embodiments, scores other than those discussed above may be used. Preferably, however, a touchdown is given more weight than a field goal, which is given more weight than a two-point conversion, which is given more weight than an extra point.

Although embodiments of the present invention were described relative to advancing a specific type of game piece (i.e., a golf ball) into specific targets (i.e., holes and colored or outlined zones), the present invention is not so limited. The present invention may also be used with other game pieces and other types of targets. As used herein, the term "game piece" refers to the object that a team advances to the targets.

For example, the present invention may be implemented using a croquet set, where the game piece to be advanced is a croquet ball and the targets may be, for example, croquet hoops known as wickets. As another example, the present invention may be implemented using a shuffle board set, where the game piece to be advanced is a puck and the targets may be colored or outlined zones on the playing surface. As yet another example, the present invention may be implemented using a horseshoes set, where the game piece to be advanced is a horseshoe and the targets may be the stakes used in horseshoes. As even yet another example, the present invention may be implemented using balls other than golf balls and by kicking or throwing the balls at above-ground targets or hoops. Accordingly, the phrase "receiving a game piece" should be construed as including, a golf ball coming to rest in a hole or in a colored or outlined zone, a horseshoe coming to rest around a stake, a shuffleboard puck coming to rest in a colored or outlined zone, a ball coming to rest on a target covered with hook and loop fastener, and so forth.

Yet further, the present invention may also be implemented in miniature, such as a tabletop game played with either mini-clubs, fingers, or some other kind of devices used as putters.

Even yet further, games of the present invention may also be implemented in video games.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A gaming surface for playing a game, the gaming surface comprising at least one playing area including a putting green, each putting green comprising:

a set of material markings on the gaming surface comprising:

a first sideline and a second sideline, substantially parallel to the first sideline, wherein the first and second sidelines define the playing area;

a set of substantially parallel and substantially evenly spaced lines extending between the first and second sidelines and forming a grid;

a first marker corresponding to a starting position for a player to set a golf ball in motion in the general direction of a defined end zone on a side of the gaming surface opposite the first marker; and a plurality of numerical markings that decrement relative to the first marker, each numerical marking indicating a distance between the end zone and a corresponding line in the set of substantially parallel and substantially evenly spaced lines; and a set of targets comprising:

an ultimate target spaced apart from the first marker and generally positioned in the end zone; and a set of intermediate targets, wherein:

each intermediate target is spaced apart from the first marker by a different distance;

the intermediate targets are positioned in an area that is between the first marker and the ultimate target; and each target in the set of targets has an opening formed therein, the opening forming a hole in the gaming surface adapted to receive a golf ball.

2. The gaming surface of claim 1, wherein the set of substantially parallel and substantially evenly spaced lines comprises at least five lines.

3. The gaming surface of claim 1, wherein each of the intermediate targets is positioned on or adjacent to a different line of the set of substantially parallel and substantially evenly spaced lines.

4. The gaming surface of claim 1, wherein:

the at least one playing area comprises first and second playing areas; and the second sideline of the second playing area is substantially parallel to the first sideline of the first playing area.

5. The gaming surface of claim 4, wherein the first sideline of the second playing area is the second sideline of the first playing area.

6. The gaming surface of claim 4, wherein:

the at least one playing area further comprises a third playing area; and the first sideline of the third playing area is substantially parallel to the first sideline of the first playing area.

7. The gaming surface of claim 6, wherein:

the at least one playing area further comprises a fourth playing area; and the second sideline of the fourth playing area is substantially parallel to the second sideline of the second playing area.

8. The gaming surface of claim 1, further comprising an additional playing area, different from the at least one playing area, the additional playing area comprising:

an additional set of material markings on the gaming surface comprising:

a pair of substantially parallel sidelines, wherein the pair of sidelines define the additional playing area; and a second marker corresponding to a starting position for a player to set a golf ball in motion; and an additional ultimate target spaced apart from the second marker.

9. The gaming surface of claim 1, wherein:

the numerical markings decrement by tens; and each numerical marking has digits that are positioned adjacent to the corresponding line.

10. The gaming surface of claim 4, wherein:

the first marker of the first playing area is on a side of the gaming surface opposite the first marker of the second playing area; and the ultimate target of the first playing area is on a side of the gaming surface opposite the ultimate target of the second playing area.

11. The gaming surface of claim 6, wherein the first sideline of the first playing area is the second sideline of the third playing area.

12. The gaming surface of claim 7, wherein the second sideline of the second playing area is the first sideline of the fourth playing area.

13. The gaming surface of claim 1, wherein the set of material markings on the gaming surface comprises, for each target in the set of targets, at least one material marking corresponding to a starting position for a player to set a golf ball in motion, each of the at least one material marking being different from the substantially parallel and substantially evenly spaced lines.

14. The gaming surface of claim 13, wherein the set of material markings on the gaming surface comprises, for each target in the set of targets, a plurality of material markings, each corresponding to a starting position for a player to set a golf ball in motion and each lying in an area that extends from one of the substantially parallel and substantially evenly spaced lines to an immediately adjacent one of the substantially parallel and substantially evenly spaced lines.

15. The gaming surface of claim 1, wherein:

the at least one playing area comprises first and second playing areas;

each playing area comprises:

at least five substantially parallel and substantially evenly spaced lines;

at least four intermediate targets, wherein each intermediate target is positioned on or adjacent to a different one of the at least five substantially parallel and substantially evenly spaced lines; and at least four material markers for each target in the set of targets, each material marker corresponding to a starting position for a player to set a golf ball in motion toward the target; and the first sideline of the first playing area is parallel to the second sideline of the second playing area.

16. The gaming surface of claim 1, wherein each numerical marking consists of two digits that straddle the corresponding line.

17. The gaming surface of claim 1, wherein the substantially parallel and substantially evenly spaced lines are spaced less than ten yards apart.

18. The gaming surface of claim 1, wherein the substantially parallel and substantially evenly spaced lines are spaced fifteen feet apart or less.

* * * * *